US005205600A

United States Patent [19]

Moore

[11] Patent Number: 5,205,600

[45] Date of Patent: Apr. 27, 1993

[54] AUTOMATIC RELEASE COUPLING

[76] Inventor: Richard Moore, 2332 NE. 28th Ct., Lighthouse Point, Fla. 33064

[21] Appl. No.: 853,101

[22] Filed: Mar. 18, 1992

[51] Int. Cl.[5] ..... B66C 1/38

[52] U.S. Cl. ..... 294/82.27; 294/82.33

[58] Field of Search ..... 294/75, 82.25-82.27, 294/82.31, 82.33, 82.34; 114/249, 252, 377-380

[56] References Cited

U.S. PATENT DOCUMENTS

| | | | |
|---|---|---|---|
| 916,005 | 3/1909 | Owen | 294/82.33 |
| 1,101,113 | 6/1914 | Attfield | 294/82.27 X |
| 2,131,445 | 9/1938 | Lawton | 294/82.27 X |
| 2,328,341 | 8/1943 | Higgins et al. | 294/82.27 X |
| 2,732,246 | 1/1956 | Bernhart | 294/82.33 |
| 3,109,676 | 11/1963 | Mercer | 294/82.31 |
| 3,493,260 | 2/1970 | Smith | 294/82.33 |
| 4,471,511 | 9/1984 | Phipps | 294/82.33 |

FOREIGN PATENT DOCUMENTS

| | | | |
|---|---|---|---|
| 698825 | 11/1940 | Fed. Rep. of Germany | 294/82.33 |
| 568215 | 3/1945 | United Kingdom | 294/82.33 |
| 910904 | 11/1962 | United Kingdom | 294/82.27 |
| 1146891 | 3/1969 | United Kingdom | 294/82.33 |
| 1182603 | 2/1970 | United Kingdom | 294/82.33 |

*Primary Examiner*—Johnny D. Cherry
*Attorney, Agent, or Firm*—Malin, Haley, DiMaggio & Crosby

[57] ABSTRACT

An automatic quick release coupling/decoupling mechanism for deploying and retrieving a tethered object such as a rescue boat, life boat, or the like, the mechanism generally comprised of a frame a hook member pivotally attached to the frame a lock member pivotally attached to the frame a lock pin slidably disposed in a slot in the frame and a trip member pivotally attached to the frame, the hook member having first and second hook portions adapted to engage the lock pin and a lift ring attached to the tethered object, respectively, and an attached counterweight disposed eccentric to the pivot point, the lock member having first and second recessed portions separated by a cam surface, the first recessed portion adapted to engage the lock pin in a first, locked position wherein the lock pin also engages the first hook portion of the hook member, whereby the lock pin may be biased within the frame slot along the cam surface of the lock member into the second recessed portion, thereby allowing the hook member to rotate freely about its pivot point when the moment generated thereabout by the eccentric counterweight overcomes frictional forces between the lift ring and the second hook portion of the hook subsequent to lowering the rescue boat into a body of water where buoyant forces on the boat relieve tension in the tether, and whereby the tethered object may be retrieved by reversing the process.

7 Claims, 3 Drawing Sheets

AUTOMATIC RELEASE COUPLING

BACKGROUND OF THE INVENTION

1. Field of the Invention

This invention relates generally to automatic quick-release couplings, and more particularly to a hook mechanism for deploying and retrieving tetherable objects using a gravity-responsive object-release feature.

2. Description of the Prior Art

Release couplings for deploying and retrieving tetherable bodies are known in the art, an example of which is disclosed in U.S. Pat. No. 4,587,922 issued to Oiestad. Oiestad teaches the use of a suspension device wherein a holding member is pivotally mounted in a support for attachment to a boat, and in which a pair of concave gripping rollers are pivotally mounted for engagement with a spherical suspension member at the end of the suspension line.

U.S. Pat. No. 4,610,474 issued to Jaatinen, U.S. Pat. No. 4,281,867 issued to Kariagan, and U.S. Pat. No. 4,095,833 issued to Lewis, all disclose devices for disengaging a cable loop from a hook. However, none of these patents teach the use of an automatic coupling which automatically and safely releases a tethered body from a loaded cable when the load thereon is reduced, for example, upon deployment of the body onto a body of water, using counterweights to move the hook member into a release position.

SUMMARY OF THE INVENTION

In accordance with the instant invention, there is disclosed an automatic quick-release coupling/decoupling mechanism which essentially comprises: a frame; a hook pivotally attached to the frame for deploying or retrieving a body and being movable from a first, locking position to a second, release position, responsive to a means for biasing; means for locking the hook into the locking position, the locking means also being pivotally attached to the frame, and a lock pin member slidably disposed in the housing and adapted to retain the means for locking and hook in the release position.

The frame comprises a pair of elongated planar side members, rigidly attached to, but spaced from, one another and disposed in parallel relationship so as to define an internal cavity therebetween. The housing members and all the other components of the device may be fabricated from metal or an alternative material suitable for use in harsh environments. Both frame members define a plurality of apertures therethrough for pivotal attachment of the hook, locking means, and trip means which will be discussed in greater detail hereinbelow. An elongated slot is defined in the frame members in which a lock pin member is slidably disposed.

The lock pin member may be a standard shearpin type, having an intermediate body portion of greater diameter than its two ends. The intermediate body portion is disposed in the internal cavity between the frame members.

The coupling comprises a plate or hook structure of irregular plan form which is sized to fit for partial rotational movement within the interior cavity defined between the frame members, and which is pivotally attached to the frame members at a point eccentric to the center of mass of the hook. The hook defines integral first and second hook portions, the first hook portion adapted to engage the lock pin member in the aforesaid first, locked position, and the second hook portion configured to support a tethered object. Accordingly, the shear bolt which pivotally attaches the hook to the frame members is sized to support the full weight of the object when in the stowed, or locked position. Biasing means, such as counterweights, are attached to the hook structure and are disposed eccentric to the pivot point so that, after the locking means is disengaged and the object, such as a rescue boat, is lowered into the water so that the buoyant force relieves the load in the support cable, the moment generated by the weights on the hook will overcome any residual friction between the lift ring attached to the rescue boat or support cable and the second hook portion, to cause the hook to rotate to an open position and thereby release the object. The coupling is equally suitable for use with objects to be deployed onto land or other support surfaces. All that is required for automatic decoupling is a support surface onto which the object can be placed to relieve tension in the supportive line or fitting.

The locking means comprises a lever-type structure which is pivotally attached to the frame members at a location remote from the pivotal attachment of the hook to the frame members. The locking means includes a first and second recessed portion defined by the outer periphery thereof, separated by a cam surface for engaging the lock pin member. When the locking means is in a first, closed, position, the locking pin member is positioned, due to gravity, at the bottom of the elongated slot and engages the first recessed portion of the locking means and the first hook portion of the hook. In this manner, the hook is safely maintained in a closed and locked position. When the object is to be deployed, the locking means is rotated such that the lock pin member is disengaged from the recessed portion and raised in the track means along the cam surface into the second recessed portion, thereby being disengaged from the first hook portion of the hook to permit free rotation of the hook. At this point, the hook is held in a closed position by the load on the second hook portion through the hook pivot point caused by the weight of the object to be deployed. When the object is lowered into the release position and the load is relieved, the weight of the object on the hook is relieved, so that the counterweight rotates the hook member and the object is deployed free of the device. When the object is to be retrieved, the process is reversed. The hook is rotated back into the locked position and the object attachment is hooked over the second hook portion. The lock is rotated in reverse which biases the lock pin member into the first, closed, position, thereby safely locking the entire device.

To facilitate activating the locking means, actuating means such as a lanyard may be employed so that the device may be easily and/or remotely enabled. The lanyard may be attached to a handle on the locking means, and routed through a fairlead attached to either one or both of the housing members.

Finally, means for tripping the hook in the event of inadvertent jamming may be employed to manually rotate the hook means should the counterweight be insufficient to overcome friction between the object and the hook. The trip means comprises a lever member pivotally attached to the housing members, adapted to engage the hook means and attached lanyard in a similar fashion to the actuating means.

In accordance with the instant invention, it is an object thereof to provide a quick-release coupling for deploying or retrieving an object.

It is a further object of the instant invention to provide an automatic quick-release coupling which employs a specially configured pivotal hook apparatus having an eccentrically disposed counterweight to automatically release or lock when the object is lowered into, or raised from, a support surface, respectively.

It is still another object of the instant invention to provide a quick-release coupling which is structurally efficient and capable of low cost manufacture.

It is a still further object of the instant invention to provide a coupling employing an automatic release feature responsive to the weight of the coupled object being released.

In accordance with these and other objects which will become apparent hereinafter, the instant invention will now be described with particular reference to the accompanying drawings.

DESCRIPTION OF THE PREFERRED EMBODIMENT

Figure 2:
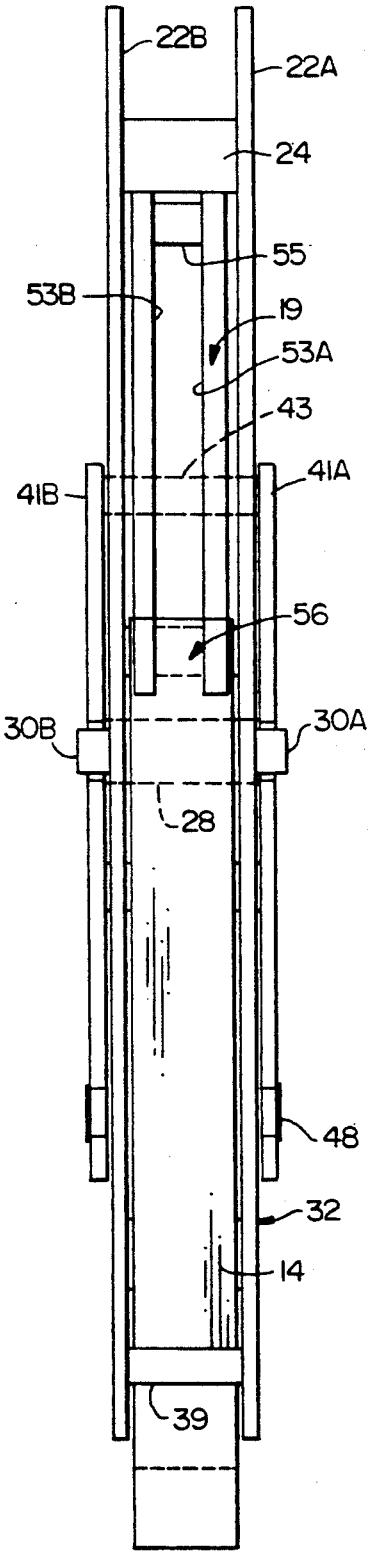
FIG. 2 is a frontal elevational view of the hook assembly.

With reference to the several views of the drawings, there is disclosed an automatic quick-release coupling-/decoupling mechanism for retrieving and deploying a tethered object, such as a rescue boat, generally denoted by the reference numeral 10, which essentially comprises: a frame 12; a hook 14 for hooking a tethered object; means 16 for locking the hook; a lock pin member 18; trip means 19, and activating means 20 for rotating the locking means between a first, locked position and a second, open position.

Figure 1:
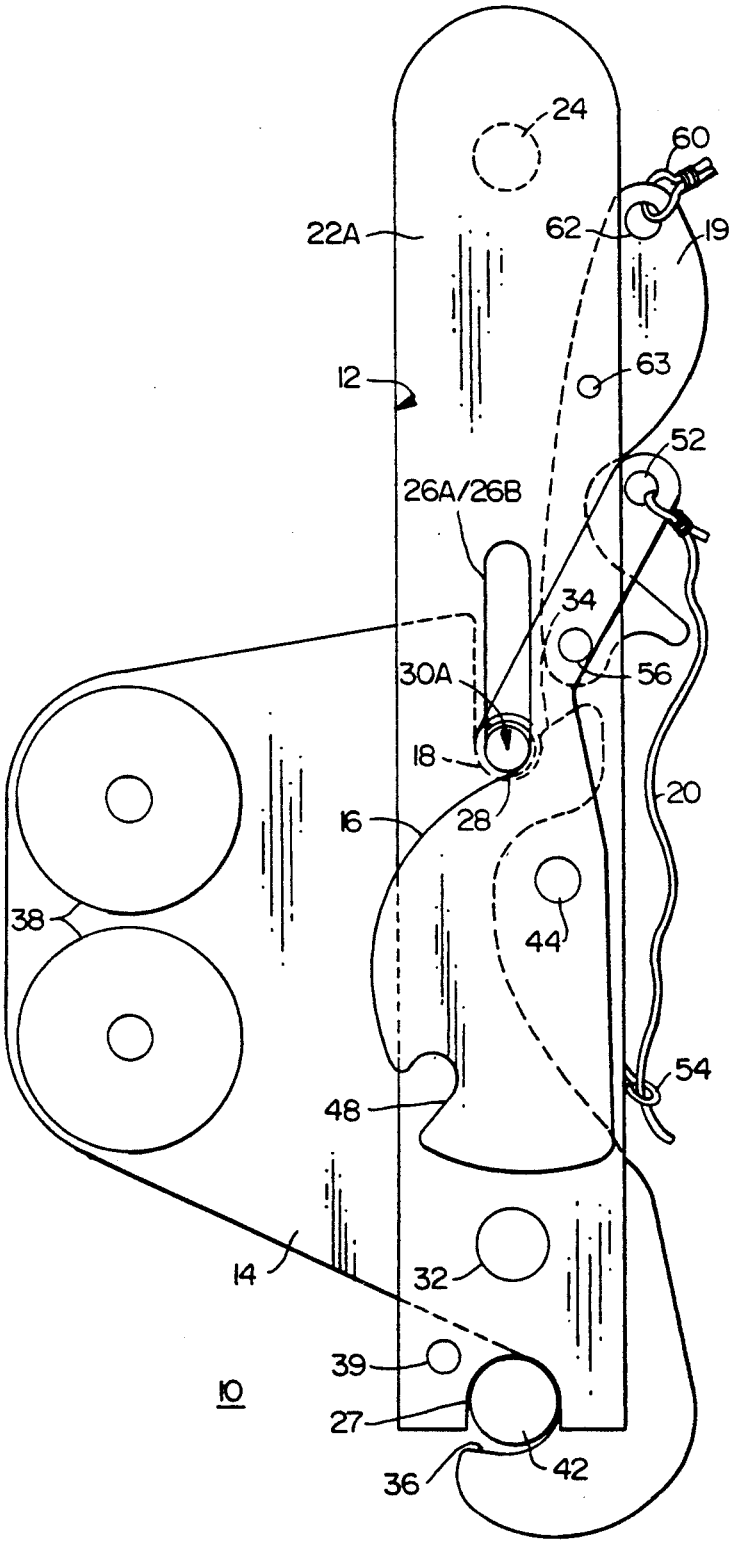
FIG. 1 is a plan view of the hook assembly in a closed or "hooked" position.

Referring to FIGS. 1 and 2, the frame 12 comprises a pair of elongated planar side members **22*a* and 22*b* of nominal wall thickness, rigidly attached to one another and disposed in parallel relationship so as to define an internal cavity therebetween. Frame members 22*a* and 22*b* may be affixed to each other by connecting member 24. Both frame members define a plurality of apertures therethrough for pivotally attaching the hook 14, locking means 16, and trip means 19, which will be discussed in greater detail hereinbelow. Elongated slots 26*a* and 26*b* are defined in frame members 22*a* and 22*b*, respectively, in which lock pin member 18 is slidably disposed, and cutout 27 is provided to accept a lift ring from the tethered device. Frame members 22*a* and 22*b*** may be attached to the davit of an oil rig or mothership which may be translated vertically up or down to deploy or retrieve the tethered object.

Lock pin member 18 may be of the standard shearpin type, having an intermediate body portion 28 of greater diameter than its two ends, **30*a* and 30*b*. Ends 30*a* and 30*b* are sized to slidably fit within slots 26*a* and 26*b*, and the greater diameter of intermediate body portion 28 retains the pin between housing members 26*a* and 26*b***, respectively.

Figure 3:
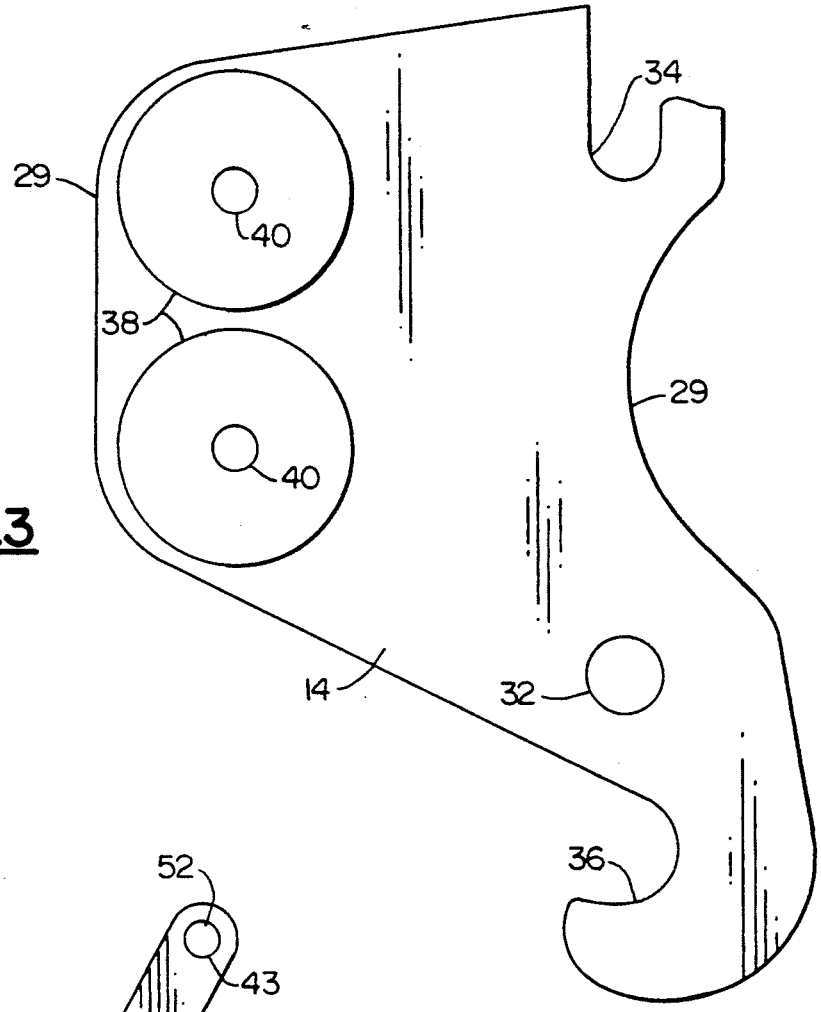
FIG. 3 is a plan view of the hook.

Referring to FIG. 3, hook 14 comprises a planar hook structure of irregular plan form defined by peripheral surface 29 which is sized to fit within the interior cavity defined between frame members **22*a* and 22*b*, and which is pivotally attached to the frame members at a point eccentric to the center of mass of the hook by shearpin 32. The hook structure defines integral first and second hook portions 34 and 36, respectively, wherein first hook portion 34 is adapted to engage ends 30*a* and 30*b* of lock pin member 18 in the aforesaid first, closed position, and second hook portion 36 is adapted to support the tethered object, as shown in FIG. 1 when the hook is in a hooked position. Shearpin 32 is sized to support the full weight of the tethered object when in the stowed or hooked position. At least one counterweight 38 is attached to the hook structure at a location eccentric to the pivot point 32, by bolt 40 or other conventional means. When locking means 16 are disengaged and when the tethered object is lowered onto a support surface such that the load in the support cable is relieved, the moment generated by the weight on the hook about pivot point 32 will overcome any residual friction between lift ring 42 and second hook portion 36, thereby allowing the hook to rotate to an unhooked position, releasing the tethered object. A stop member 39 is interposed between, and rigidly connected to, frame members 22*a* and 22*b*** to restrict the rotational movement of the hook structure in the unhooked position.

Figure 4:
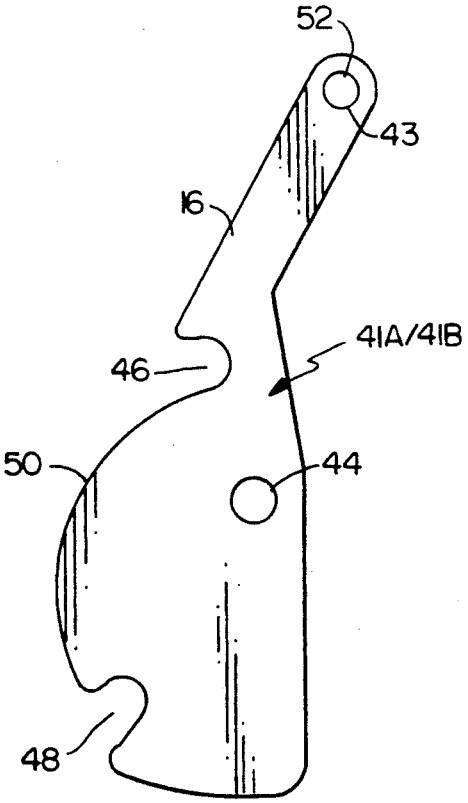
FIG. 4 is a plan view of the lock.

Referring now to FIGS. 2 and 4, locking means 16 comprises a lever-type structure having planar side members **41*a* and 41*b* rigidly joined therebetween by connecting member 43, which is pivotally attached to housing members 22*a* and 22*b* by a shearpin 44 at a location remote from hook means 14. Locking means 16 includes a first and second recessed portion 46 and 48, respectively, defined in the outer periphery thereof, separated by a cam surface 50 for engaging lock pin member 18 Connecting member 43 may have an aperture 52 therethrough for accepting a lanyard 54** or equivalent actuating mechanism as will be discussed hereinbelow.

Figure 5:
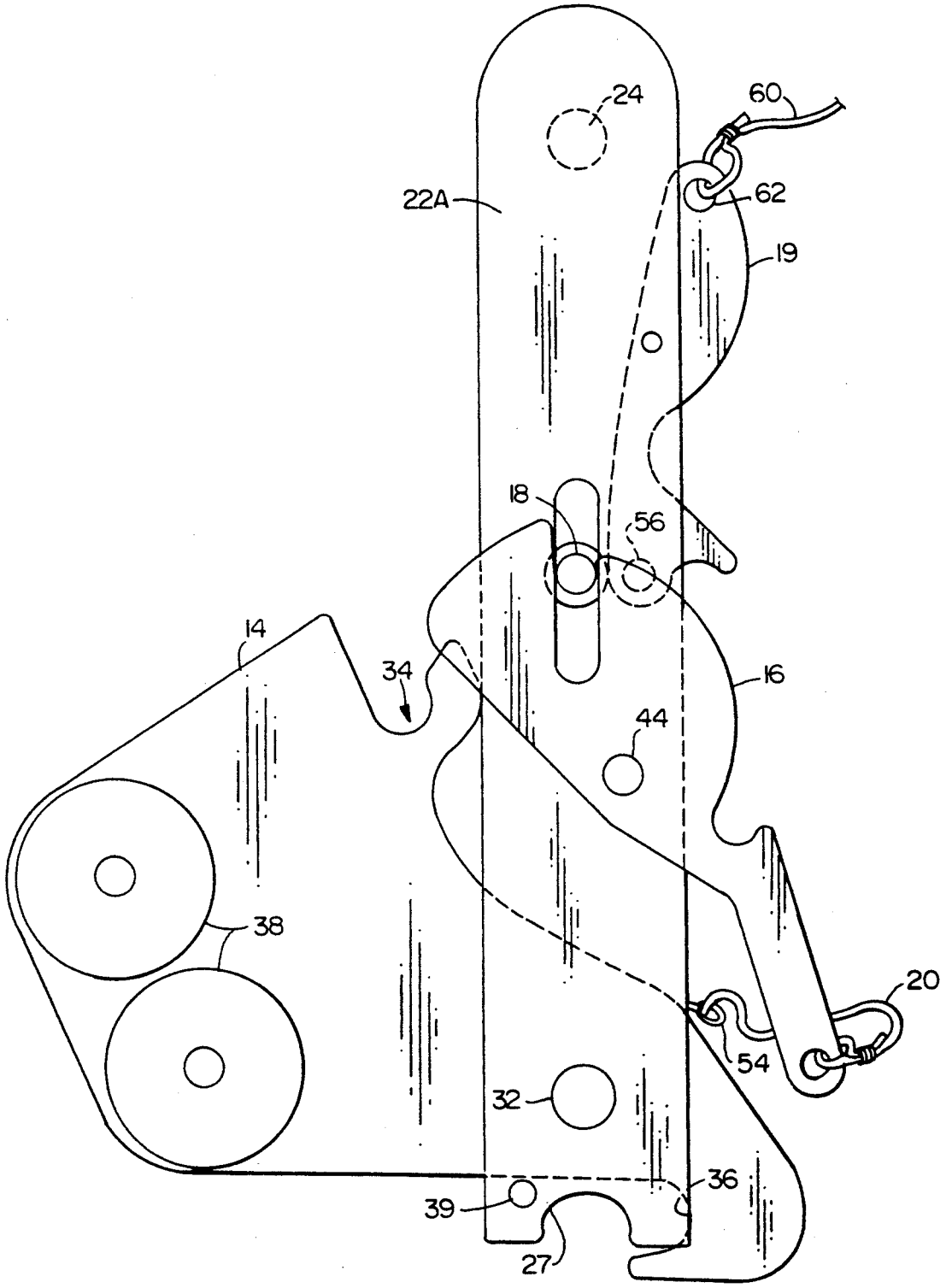
FIG. 5 is a plan view of the hook assembly in an unhooked or open position.

When locking means 16 is in the first, closed position, the weight of lock pin member 18 causes it to be positioned at the bottom of slots **26*a* and 26*b*, and engaged by first recessed portion 46. Accordingly, hook 14 is prevented from rotating about pin 32 and safely remains in a hooked or closed position. When the tethered object is to be deployed, locking means 16 are rotated such that cam surface 50 biases lock pin member 18 upward, within slots 26*a* and 26*b*, and into second recessed portion 48, thereby freeing first hook portion 34 and permitting hook 14 to rotate freely around shearpin 32. Because the hook is locked in position by the weight of the tethered object, its force component being coincidental with the vertical axis of shearpin 32, the hook is prevented from rotating until the tethered object is lowered onto a support surface, thereby relieving the load in the tether. When the tether becomes slack, the frictional loads between second hook portion 36 and lift ring 42 may be overcome by the moment generated around shearpin 32 by counterweight(s) 38, which causes the hook to rotate into a second, unhooked position, thereby deploying the tethered object free of the device. FIG. 5 depicts the apparatus in the unhooked condition after the boat is deployed, or prior to retrieval when the process is reversed. When the object is to be retrieved, the lift ring 42 is inserted over second hook portion 36 after hook 14 has been rotated back into the closed position. Locking means 16 are subsequently rotated in reverse into the first, locked position, biasing lock pin member 18 along cam surface 50 down to the bottom of slots 26***a* and 26*b*, where it again engages first recessed portion 46 of locking means 16 and first hook portion 34 of hook 14, thereby safely locking the entire device.

To facilitate activating locking means 16 from a remote location, actuating means 20, such as a lanyard, may be employed. The lanyard may be attached to the lever portion of locking means 16 through aperture 52, and routed through a fairlead 54 attached to either one or both of the members 22*a* and 22*b*.

Figure 6:
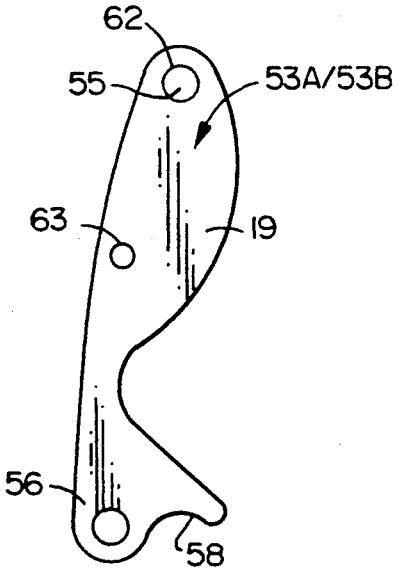
FIG. 6 is a plan view of the trip.

Referring to FIG. 6, trip means 19 for tripping the hook in the event of inadvertent jamming may be employed to manually rotate hook means 14 should the counterweight be insufficient to overcome friction between lift ring 42 and hook means 14. Trip means 19 comprises a lever-type structure having planar side members 53*a* and 53*b* rigidly joined therebetween by connecting member 55, similar to locking means 16, which is pivotally attached to housing members 22*a* and 22*b* around shearpin 56, and which is adapted to engage the external periphery of hook 14 near the corner thereof, with extended surface 58. A lanyard 60 may be attached to trip means 19 through aperture 52 defined in connecting member 55, and routed through a fairlead 62 in a similar fashion to actuating means 20, so that hook 14 may be remotely actuated. To disable trip means 19, a removable shear pin 62 engageable with a corresponding aperture in housing members 22*a* and 22*b* may be provided.

Finally, the structural components of the device may be fabricated from metal or an alternative material suitable for use in harsh environments.

The instant invention has been disclosed in what is considered to be the most practical and preferred embodiment. It is recognized, however, that departures may be made therefrom and that obvious modifications will occur to a person skilled in the art.

What is claimed is:

1. An automatic release hook apparatus for retrieving and deploying a tethered object, comprising:

a frame, defining an elongated slot;

means for hooking said tethered object, said means for hooking pivotally connected to said frame about a first axis;

means for releasably retaining said means for hooking pivotally connected to said frame about a second axis, remote from said first axis;

a lock member slidably disposed in said slot, said lock member engageable with said means for retaining in a first, locked, position and a second, open, position; and means for automatically rotating said means for hooking from a first, hooked, position to a second, unhooked, position when said means for retaining is rotated from said first, locked, position to said second, open, position.

2. An automatic release hook apparatus for retrieving and deploying a tethered object, comprising:

a pair of elongated planar frame members rigidly attached to one another and disposed in parallel relationship so as to define an internal cavity therebetween, said frame members defining an elongated slot therein;

means for hooking said tethered object, pivotally attached to said frame members and disposed in said cavity therebetween, said means for hooking defining first and second hook portions;

means for releasably retaining said means for hooking including first and second recessed portions defined by the external periphery thereof, said means for retaining pivotally attached to said frame members;

a means for locking slidably disposed in said elongated slot which engages said first recessed portion in said means for retaining and said first hook portion of said means for hooking when said means for retaining is oriented in a first, locked, position, and which engages said second recessed portion in said means for retaining when said means for retaining is rotated to a second, open, position;

means responsive to gravity for automatically rotating said means for hooking from a first, hooked, position to a second, unhooked, position when said means for retaining is rotated from said first, locked, position to said second, open, position.

3. The apparatus of claim 2, further comprising:

actuating means for rotating said means for retaining from said first, locked, position to said second, open, position, said actuating means pivotally attached to said means for retaining, whereby when said tethered object is supported by said second hook portion of said means for hooking, and said lock member engages said first recessed portion in said means for retaining, said tethered object is supported by said apparatus, and when said tethered object is lowered on a support surface, the tension caused by said tethered object is relieved, thereby reducing friction between said tethered object and said second hook portion so that when said means for retaining are rotated from said first locked position to said second open position, said means for hooking is free to rotate to said unhooked position, thereby freeing said tethered object.

4. The automatic release hook apparatus as recited in claim 3, further comprising trip means for manually tripping said means for hooking, said trip means pivotally attached to said frame members.

5. The automatic release hook apparatus as recited in claim 3, wherein said actuating means for rotating said means for retaining comprises a lanyard attached to said means for retaining, and a fairlead attached to one of said frame members for guiding said lanyard therethrough.

6. The automatic release hook apparatus as recited in claim 3, wherein said external periphery of said means for retaining includes a cam surface profile disposed intermediate said first and second recessed portions.

7. The automatic release hook apparatus as recited in claim 3, wherein said means responsive to gravity comprises at least one counterweight attached to said means for hooking, said counterweight being disposed eccentrically to said pivotal attachment between said means for hooking and said frame members.

* * * * *